United States Patent [19]

Hernandez

[11] Patent Number: 4,625,340

[45] Date of Patent: Dec. 2, 1986

[54] CARRIER POCKET

[75] Inventor: Robert D. Hernandez, Modesto, Calif.

[73] Assignee: Komfort Karrier, Inc., Turlock, Calif.

[21] Appl. No.: 837,908

[22] Filed: Mar. 10, 1986

[51] Int. Cl.[4] ..... A41D 27/20

[52] U.S. Cl. ..... 2/247

[58] Field of Search ..... 2/247, 248, 249, 250, 2/251, 252, 253, 254; 224/222

[56] References Cited

U.S. PATENT DOCUMENTS 2,810,132 10/1957 Nicholson ..... 2/247

2,908,982 10/1959 Corley ..... 2/247

*Primary Examiner*—Doris L. Troutman

*Attorney, Agent, or Firm*—Lothrop & West

[57] ABSTRACT

A carrier pocket textile sleeve is worn around the calf of the user. The sleeve has an open-top pocket formed between the sleeve and an overlying rectangular textile sheet secured around its edges to the sheet except for a top portion. Overlying the top portion is a textile flap along its top edge secured to the sleeve and near its bottom edge carrying one part of a Velcro fastener, the other part of which is secured to the sheet below the open-top pocket. Interengagement of the Velcro fasteners in any several positions holds the flap substantially to close the open-top pocket.

3 Claims, 4 Drawing Figures

FIG-1
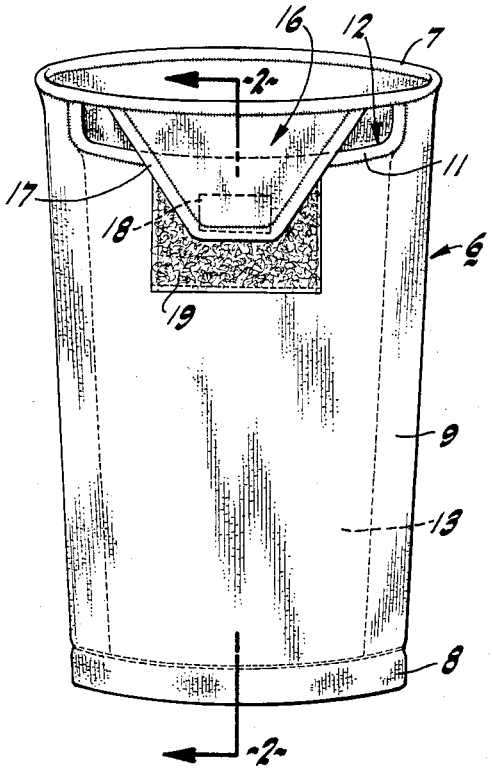
FIG-2
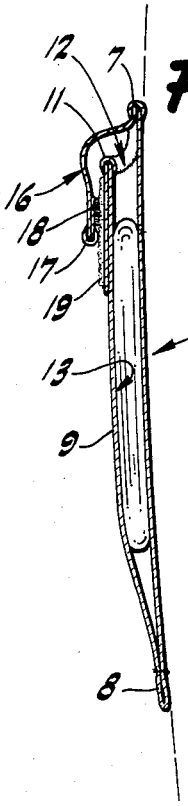
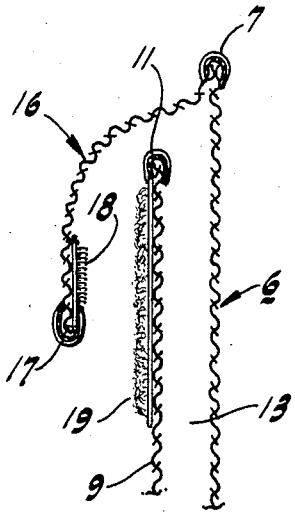
FIG-3
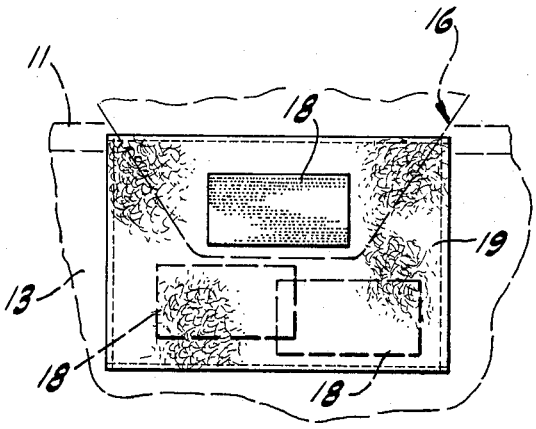
FIG-4

CARRIER POCKET

BRIEF SUMMARY OF THE INVENTION

An open-top pocket formed by an overlying textile sheet on a textile sleeve worn around the calf is closable by a textile flap at its top end secured to the sleeve and extendable downwardly across the open top of the pocket. One Velcro fastener part is secured across the bottom end of the flap, and the other Velcro fastener part is secured to the sheet in position to be engaged by the one Velcro fastener in any of several locations of the flap with respect to the pocket.

BACKGROUND OF THE INVENTION

For some years there has been available a device for carrying various personal items on the leg of the user. The device is primarily a tubular knitted sleeve worn around the calf of the leg, stopping below the knee and above the ankle. The sleeve is provided with an overlying textile panel which is integrally formed or secured in place all around its edges except for an opening at the top. This affords an easily accessible pocket for receiving a passport, a wallet, a comb, a pencil, or similar items. These pocketed sleeves have gone into widespread use with considerable success, but occasionally it has been found that the user, perhaps in running, can dislodge some of the contained items without realizing it.

It is therefore an object of the invention to provide a means for closing at least temporarily the open top of the pocket in order to secure in position any items therein.

Such a device with the accompanying closure feature is illustrated in the accompanying drawings.

BRIEF DESCRIPTION OF THE SEVERAL VIEWS OF THE DRAWINGS

FIG. 1 is a side elevation of the carrier as it appears on the leg of a user and with the pocket closed by an appropriately secured flap.

FIG. 2 is a cross-section, the plane of which is indicated by the line 2—2 of FIG. 1.

FIG. 3 is a view in section and enlarged from a part of FIG. 2.

FIG. 4 is a view like FIG. 1 and showing different possible positions of the fastener.

DETAILED DESCRIPTION

As particularly shown in FIG. 1, there is provided a tubular sleeve 6 of textile material, usually a knitted, somewhat elastic fabric, of sufficient circumference to fit easily around the user's calf. The sleeve extends between a rolled top edge 7 just below the user's knee to a wider seam 8 at the bottom edge just above his ankle. The single layer sleeve 6 is augmented by an overlying sheet 9 of a generally similar textile or knitted material of a generally rectangular shape in elevation. The sheet 9 has about the same height as the sleeve 6 except that at least a peripherally extending portion of the sheet stops with an edge or margin 11 spaced substantially below the edge 7. This upper edge of the sheet, not secured to the sleeve and free thereof, leaves an opening 12 at the top of a pocket, generally designated 13, formed between the secured side edges and bottom edge of the sheet and the sleeve. The dimensions of the pocket and of the opening 12 are such that personal articles; for example, bank books, wallets, passports, combs, pencils, and the like, can readily be inserted therein and are normally retained by the elasticity of the sleeve and the sheet. In some instances, more than one pocket like the pocket 13 is provided on the sleeve 6.

Particularly in accordance with the present improvement, and for more security, there is provided a flap 16 preferably of a similar textile material of approximately trapezoidal or triangular shape and along its upper edge merging with and secured to the edge 7. The edges 17 of the flap are also conveniently rolled or enlarged like the edge 7. The flap is long enough to overlap the sheet 9 below the opening 12. The overlapping bottom portion of the flap 16 carries one part 18 of a Velcro fastener, preferably the portion thereof having hooks or barbs.

The other portion 19 of the customary Velcro fastener, the part with loops, is preferably secured to the material of the sheet 9. The fastener portion 19 ranges substantially along and below the transverse edge of the opening 12 and is of substantially larger area both vertically and transversely than the area of the Velcro fastener portion 18.

In the use of this closure device, items are put into the pocket 13 when the flap 16 is detached at the bottom end and is flexed out of the way. After the items have been put into the pocket, the flap is then put into a position overlying the opening 12 and the Velcro fastener part 18 is put into engagement with the Velcro fastener part 19. The relative vertical position of the fastener parts is effective to allow some bulging or slight shifting of the pocket contents. The fastener portion 18 can likewise be positioned laterally into different locations with respect to the fastener portion 19. Thus, even if some contents are put into the pocket and are askew or at a slant or have odd shapes, the fastener relative areas are sufficient to permit selected, firm fastening interengagements to be made. The closure is such that the pocket does not open without prior manual separation of the fastener parts 18 and 19.

In this way there has been provided a simple, consistent and effective way to assist in securing materials within the pocket against inadvertent release thereof.

I claim:

1. A carrier pocket for wear on the leg comprising a sleeve having a top margin and adapted to fit around the calf, a substantially quadrilateral sheet adapted to overlie a portion of said sleeve and having one upper edge part registering with said top margin and having another spaced edge part parallel to and located below said upper edge part to leave a gap therebetween, means for securing the edges of said sheet to said sleeve except along said spaced edge part, a flexible flap having top and bottom edges, means for securing said top edge of said flap to said upper edge part of said sleeve with said flap adapted to overlie said gap, a two-part Velcro fastener, means for securing one part of said Velcro fastener to said flap near the bottom edge of said flap, and means for securing the other part of said Velcro fastener to and along said spaced edge part of said sheet.

2. A carrier pocket as in claim 1 in which said one part of said Velcro fastener has a predetermined area and said other part of said Velcro fastener is of substantially lesser area to occupy various different fastened positions in engagement with said one part.

3. A carrier pocket as in claim 1 in which said spaced edge part of said sheet has a predetermined transverse length, and said top edge of said flap is of a lesser transverse length to leave end portions of said upper edge part of said sheet uncovered by said flap.

* * * * *